United States Patent [19]

Miller

[11] Patent Number: 4,620,072

[45] Date of Patent: Oct. 28, 1986

[54] HOLLOW NON-OCCLUDING PRESSURE SENSOR

[76] Inventor: Norman K. Miller, Concord Industrial Park, Concordville, Pa. 19331

[21] Appl. No.: 722,607

[22] Filed: Apr. 12, 1985

[51] Int. Cl.[4] ..... H01H 35/34

[52] U.S. Cl. ..... 200/81 R; 340/626; 73/723; 200/61.43; 200/83 N; 200/81 H

[58] Field of Search ..... 200/81 R, 81 H, 83 N, 200/83 S, 83 Z, 83 W, 61.7, 61.43; 340/545, 547, 626; 307/118; 73/714, 723

[56] References Cited

U.S. PATENT DOCUMENTS

| | | | |
|---|---|---|---|
| 2,071,042 | 2/1937 | Maurer | 200/83 W |
| 2,967,944 | 1/1961 | Lusted | 200/83 N |
| 3,181,522 | 5/1965 | Kofink | 200/83 N |
| 4,211,990 | 7/1980 | Gwozdz | 200/61.7 |
| 4,371,762 | 2/1983 | Diamond | 200/61.43 |

*Primary Examiner*—G. P. Tolin

*Attorney, Agent, or Firm*—Robert K. Youtie

[57] ABSTRACT

A pressure change sensor includes a flexible hollow body to receive pressure changes, an inner body in said flexible hollow body, the inner body being of a size less than and a shape different from the hollow of said hollow body to prevent total occlusion of the hollow body interior under pressure, and a fluid operated switch in fluid communication with the interior of the hollow body responsive to pressure changes applied to the hollow body.

8 Claims, 5 Drawing Figures

FIG. 1
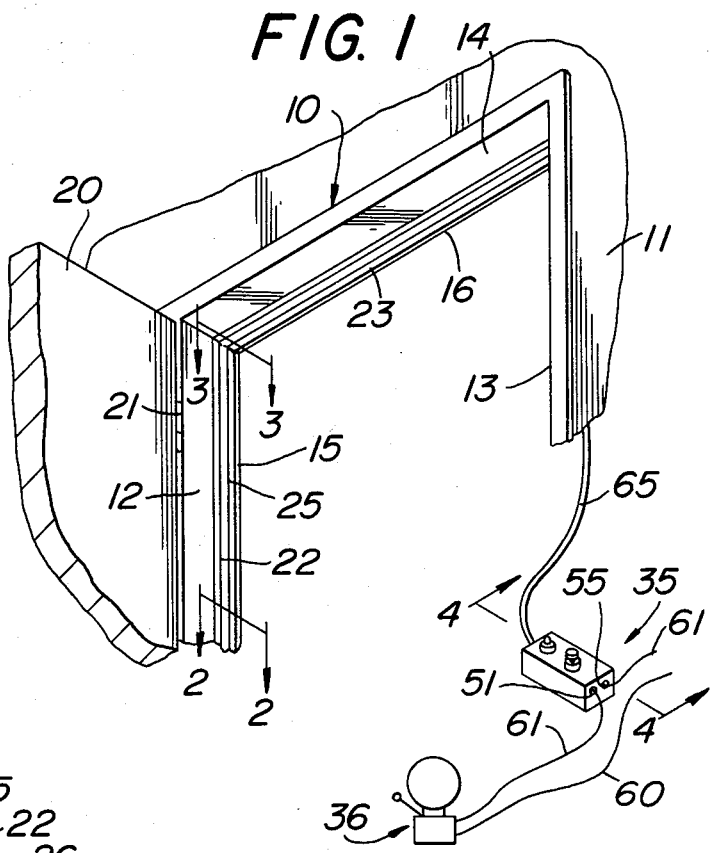
FIG. 5
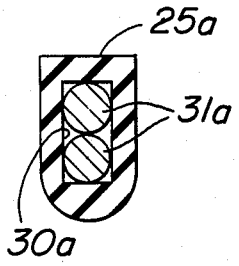
FIG. 2
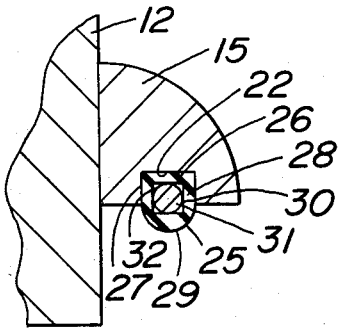
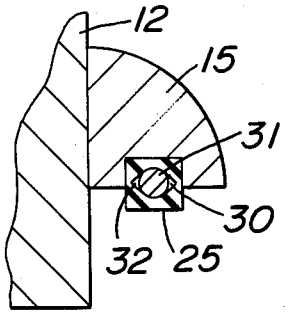
FIG. 3
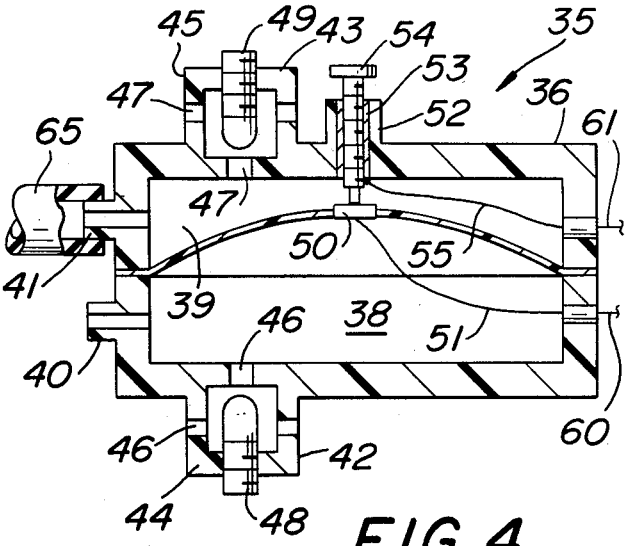
FIG. 4

HOLLOW NON-OCCLUDING PRESSURE SENSOR

BACKGROUND OF THE INVENTION

As is well known to those versed in the art, it has heretofore been relatively difficult to sense and respond to extremely small pressure changes under practical conditions of use. For example in safety door edges of elevators and public transit vehicles, in burglar detection floor switches and window and door tampering sensors, robotic finger pressure sensors, and the like, high sensitivity to small pressure change has heretofore been a difficult and expensive problem to solve. Also, in many such sensors the total closure or occlusion at one point along an elongate sensor may make the sensor totally insensitive and useless beyond the point of occlusion, so that further pressure change beyond this point is no longer sensed.

For example, in assembling an elongate pressure change sensing member or tube through a right angle or other sharp turn, there was heretofore a likelihood that the sensor would be assembled in a completely closed or occluded condition at the turn, as by a kink or crimp, and therefore assembled with total occlusion at the turn and insensitive to pressure changes beyond the turn.

SUMMARY OF THE INVENTION

It is, therefore, an important object of the present invention to provide a pressure change sensor of the type described which achieves a high sensitivity at relatively low cost, and wherein total occlusion of the sensor is effectively prevented so that the sensor is highly sensitive throughout its entire length.

It is a further object of the present invention to provide a pressure change sensor having the advantageous characteristics mentioned in the preceding paragraph, which is inexpensive to manufacture, quick and easy to assemble and install, and entirely reliable throughout a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a partial perspective view illustrating a pressure change sensor of the present invention assembled in a door opening for sensing attempted burglary.

FIG. 2 is an enlarged partial cross sectional view taken generally along the line 2—2 of FIG. 1.

FIG. 3 is an enlarged partial cross sectional view taken generally along the line 3—3 of FIG. 1.

FIG. 4 is a sectional view taken generally along the line 4—4 of FIG. 1.

FIG. 5 is a sectional view similar to FIG. 2, but showing a slightly modified embodiment.

DESCRIPTION OF THE PREFERRED EMBODIMENTS

Referring now more particularly to the drawings, and specifically to FIG. 1 thereof, a doorway is there generally designated 10, being formed in a building wall 11, and composed of generally upright doorway sides or jambs 12 and 13, and a generally horizontal top or head 14 extending between the upper ends of the jambs. Door stop strips 15 and 16 extend around the doorway, specifically along the jamb 12 and head 14, respectively. A door 20 is hinged, as at 21, to door jamb 12, for swinging movement between the illustrated open position and a closed position limited by the door stop elements 15 and 16.

The door stop 15 and 16 are formed with longitudinally extending grooves 22 and 23 facing toward the door 20 when the latter is closed. The grooves 22 and 23 of the respective door stop elements 15 and 16 open at their adjacent ends into each other, and extend at right angles to each other, as do the door stop elements. Thus, the door stop grooves 22 and 23 combine to define a continuous elongate groove having a relatively sharp bend, being a right angle bend in the illustrated embodiment. Seated in the grooves 22 and 23, and suitably secured therein, as by adhesive or other means, may be an elongate, generally tubular, flexible hollow sensor body 25. This hollow sensor body 25 is essentially of constant cross sectional configuration in its undistorted condition, and may be fabricated by extrusion of resiliently flexible material, such as vinyl, or other suitable material.

The sensor body 25 is best seen in FIG. 2 and may be of generally rectangular external configuration conformably seated in and projecting slightly beyond the groove 22 of the stop element 15. The hollow body may include a bottom wall 26 seated on the bottom wall of groove 22, and side walls 27 and 28 generally normal to the bottom wall and extending along opposite sides of the groove. The body 25 projects from the groove 22 outwardly beyond the stop element 15 and is there provided with an outer wall 29, which may be externally convexly rounded, if desired.

Formed coextensively of and within the sensor body 25, longitudinally thereof, is an internal hollow or passageway 30. In the illustrated embodiment of FIG. 2, the internal hollow 30 is of a rectangular internal cross section, but may be of other configuration, as will appear hereinafter.

Extending longitudinally along and within the hollow 30 of body 25 is a flexible, elongate inner member or body 31. The inner body 31 may be longitudinally coextensive with the outer body, but not necessarily coextensive. However, it is advantageous that the inner body 31, or length of inner body be located at each bend or turn of the outer body, for reasons which will presently become apparent.

The cross sectional configuration of the inner body 31 is necessarily of a shape different from that of the internal hollow 30 of the outer body 25, and of a cross sectional area or size less than that of the hollow. This assures the provision of openings or interstices, as at 32, between the internal surface of hollow 30 and the external surface of inner body 31. Thus, even under circumstances of extreme pressure, bending or kinking of the assembled outer and inner bodies 25 and 31, the internal hollow 30 is never completely closed or occluded, but by the aforesaid openings or interstices there remain fluid passageways in the hollow 30 communicating through and onto opposite sides of a kink, bend or pressure point.

In FIG. 3 is shown the condition of a severe bend of the hollow body 25 causing a constriction of the internal hollow 30. However, the filamentary inner body 31, being of a different external cross section from the internal cross section of the hollow 30 effectively assures one or more intersticial passageways 32 remaining between the outer and inner bodies.

In practice, flexible wire stock, either insulated or noninsulated, has been found suitable for use as the inner body 31. For example, round wire stock in a polygonal hollow has been found entirely satisfactory.

Completing the pressure change sensing system of FIG. 1 is a fluid operated switch 35 suitably connected to energize an alarm 36, or other desired device.

The switch 35 may be seen in cross section in FIG. 4 as including a hollow body or chamber 36, and interiorly of the hollow body 36 a flexible wall, partition or diaphragm subdividing the interior into a pair of separate subchambers 38 and 39.

The hollow body or casing 36 may be plastic, or nonconducting, and the internal wall or diaphragm may be rubber or elastic, also nonconducting, and normally subdividing the casing interior into subchambers 38 and 39 of generally equal size.

A pair of nipples 40 and 41 are provided on the hollow casing 36 each communicating into a respective subchamber 38 and 39.

A selectively adjustable needle valve 42 and 43 is provided on each side of the casing 36 for communication with respective subchambers 38 and 39. The needle valves 42 and 43 may be identical, each including a hollow boss, as at 44 and 45 opening through a respective constriction 46 and 47 with the adjacent subchamber 38 and 39. The hollow bosses 44 and 45 are each provided with ports 46 and 47 communicating between the interior and exterior of the respective boss; and, externally threaded valve elements 48 and 49 extend from exteriorly of each respective boss 42 and 43, in threaded engagement therethrough, into and toward the associated orifice 46, 47. Thus, the threaded needle elements 48 and 49 are selectively adjustable toward and away from the apertures 46 and 47 to achieve the desired constriction thereof.

Centrally of the diaphragm may be a movable contact 50 connected to a conductor 51 extending exteriorly of the casing 36.

A central boss 52 may be provided on the casing 36, having therein a threaded insert 53 extending between the interior and exterior of the casing. An elongate externally threaded conductive member 54 extends in threaded engagement through the insert 53 into the adjacent subchamber 39. The insert 53 may be of conductive material, and a conductor 55 may extend from the insert 53 exteriorly of the casing 36. Thus, the threaded member or screw 54 combines with the contact 50 to define a complementary contact for engagement with the contact 50 to switch closed an electrical circuit.

It will be appreciated that the diaphragm is illustrated in a distended condition, being normally substantially flat and spaced from the contact screw 54. However, the illustrated closing of switch contacts 50, 54 will occur either by an increase of pressure in subchamber 38 or a decrease in pressure in subchamber 39, either of which will distend the diaphragm to the illustrated position.

The switch contacts 50 and 54 will close momentarily upon a rise in pressure in subchamber 38 or a decrease in pressure in subchamber 39; and, upon the bleeding of excess pressure from subchamber 38 outwardly through port 46 or the bleeding of environmental pressure into subchamber 39 through port 47, the diaphragm will be restored to its spaced condition from contact 54. The length of momentary switch closure is predetermined by the constriction of orifice 46 and 47 by its respective needle element 48 and 49.

The alarm 36 in FIG. 1 is shown as connected to electrical supply conduits 60 and 61 which, in turn, may be connected to an electrical power source. The switch 35 may be connected in one of the conductors 60 and 61, say the latter, as by conductors 55 and 51, to open and close the alarm 36 to electric power.

In the illustrated embodiment of FIG. 1, with the door 20 closed and in depressing engagement with the hollow sensor body 25, the interior hollow 30 of the sensor body may be connected in fluid communication, as by tube 65, with the switch 35. That is, the sensor body 25 is connected in fluid communication with the pressure reduction or vacumn side (subchamber 39) of the switch casing 36. The door 20 in its closed condition effectively depresses or compresses the sensor body 25; and upon tampering which tends to relieve the compression by the slightest opening movement of the door, a pressure reduction or vacumn is transmitted from the sensor body 25, through tubing 65 to subchamber 39, which closes the switch contacts 50, 54 momentarily, as illustrated in FIG. 4.

Of course, it is appreciated that the sensing of increased pressure requires only connection of the sensor body 25 through tubing 65 to nipple 40 of the subchamber 38.

In FIG. 5 is shown a modification wherein a hollow flexible, elastic sensor body **25*a* is provided with an internal hollow or passageway 30*a* having an elongate, rectangular cross sectional configuration. This embodiment illustrates that a pair of flexible, filamentary inner bodies or wires 31*a* may be interposed in the hollow 30*a***. However, the essential requirements remain, that the cross sectional area of the inner body or bodies be less than that of the internal hollow; and that the cross sectional shape of the internal bodies be different from that of the internal hollow.

From the foregoing, it is seen that the present invention provides a pressure change sensor which is extremely simple in construction and operation, highly sensitive throughout a long useful life, and otherwise fully accomplishes its intended objects.

Although the present invention has been described in some detail by way of illustration and example for purposes of clarity of understanding, it is understood that certain changes and modifications may be made within the spirit of the invention.

I claim:

1. A pressure change sensor comprising a flexible hollow body located in position to receive pressure changes to be sensed, the ends of the hollow of said body being closed, a fluid operated switch in fluid communication with said hollow for response to pressure changes, and an inner body of a completely solid cross section without any enclosed hollow therein, said inner body being in the hollow of said flexible hollow body, said inner body being of a size less than the hollow of said hollow body and of a shape different from said hollow, to prevent occlusion of said hollow under pressure.

2. A pressure change sensor according to claim 1, said inner body being flexible, for concurrent flexure of said hollow and inner bodies without occlusion of said hollow.

3. A pressure change sensor according to claim 2, said flexible hollow body being elongate and said hollow extending longitudinally within said hollow body, and said inner body being elongate and extending longitudinally within said hollow.

4. A pressure change sensor according to claim 3, said hollow being of substantially constant noncircular cross sectional configuration.

5. A pressure change sensor according to claim 4, said inner body being of substantially constant generally circular cross sectional configuration.

6. A pressure change sensor according to claim 3, said inner body being substantially co-extensive longitudinally with the hollow of said hollow body.

7. A pressure change sensor according to claim 3, said inner and hollow bodies being separate bodies.

8. A pressure change sensor according to claim 7, said inner body comprising a wire.

* * * * *